United States Patent [19]

Price

[11] Patent Number: 4,487,512

[45] Date of Patent: Dec. 11, 1984

[54] PROGRAMMABLE ALARM CLOCK APPARATUS

[76] Inventor: I. Garth Price, 3255 Gateway, Apt. 235, Springfield, Oreg. 97477

[21] Appl. No.: 460,122

[22] Filed: Jan. 24, 1983

[51] Int. Cl.[3] ..... G04B 9/00; G04C 21/16

[52] U.S. Cl. ..... 368/66; 368/73; 368/250

[58] Field of Search ..... 368/10, 28, 29, 30, 368/107-113, 155-156, 243, 250, 251; 340/309.15, 309.4, 660

[56] References Cited

U.S. PATENT DOCUMENTS

| | | | |
|---|---|---|---|
| 3,968,417 | 7/1976 | Dials | 368/204 X |
| 4,079,366 | 3/1978 | Wong | 340/309.15 X |
| 4,204,196 | 5/1980 | Sueda | 340/309.15 |
| 4,264,034 | 4/1981 | Hyltin et al. | 340/309.4 X |
| 4,266,219 | 5/1981 | Foster et al. | 340/636 X |
| 4,284,944 | 8/1981 | Iwanaga et al. | 340/636 X |
| 4,301,524 | 11/1981 | Koepp et al. | 368/251 X |
| 4,385,841 | 5/1983 | Kramer | 340/309.4 X |
| 4,395,135 | 7/1983 | Frantz | 368/63 X |

*Primary Examiner*—Vit W. Miska

*Attorney, Agent, or Firm*—H. Gordon Shields

[57] ABSTRACT

Programmable alarm clock apparatus includes seven on/off switches, representing each day of the week, which may be selectively turned on or off. Visual indications of the day of the week and the time of the day are also provided. A power failure warning system is included which alerts the user of the apparatus that there has been an interruption of the power and that the entire system needs to be reset.

3 Claims, 3 Drawing Figures

PROGRAMMABLE ALARM CLOCK APPARATUS

BACKGROUND OF THE INVENTION

1. Field of the Invention

This invention relates to alarm clock apparatus, and, more particularly to alarm clock apparatus capable of being selectively programmed for actuation on different days of the week.

2. Description of the Prior Art

U.S. Pat. No. 1,234,829 discloses a mechanical alarm clock that sounds on all days of the week except Sunday. That is, it sounds on six days out of a seven-day week. The alarm clock operates on a seven-day rotational schedule, but does not actuate or sound on the seventh day. The apparatus includes a silence mechanism to prevent the sounding of the alarm regardless of the day of the week. If the silence mechanism is not utilized on a day-by-day basis, the alarm will actuate each of the six days of the week, but not on the seventh day.

U.S. Pat. No. 2,646,659 discloses an alarm clock which operates on a seven-day cycle. The days that the alarm sounds can be selected by mechanical switching. The clock may either be electromechanical or purely mechanical. An electric motor may be used to drive the clock mechanism or a spring-wound motor may be used. The clock face includes twenty-four hours so that the alarm system need not differentiate between A.M. and P.M. hours.

U.S. Pat. No. 3,564,836 discloses an alarm clock having a seven-day cycle. The alarm system rings at predetermined times on each of the days of the week that is selected for actuation by a mechanical switch. As with the '659 patent, the alarm must be turned off manually after it has sounded. The apparatus is mechanical in operation.

U.S. Pat. No. 4,060,973 discloses an alarm clock which has an automatically variable sound. The alarm mechanism has eight different sounds which sound consecutively. The apparatus is not programmable or selectible on a day-by-day basis. The sound of the alarm simply changes each time the alarm is actuated. The theory behind the apparatus is that a sleeper will not be able to get used to a particular alarm clock sound, and thus be able to sleep through the alarm, since the alarm sound changes each time the alarm sounds.

U.S. Pat. No. 4,104,865 discloses a wristwatch type of electronic time piece in which the alarm will sound at predetermined times. The apparatus does not operate on a day-by-day basis, and accordingly is not selectively programmable to go off at the same time on different days of the week. Rather, different times in a twenty-four hour period may be programmed to have the alarm sound.

U.S. Pat. No. 4,279,029 discloses an electronic time piece in which scheduled time data can be set into a counter to have an alarm sound on a specified date or on a specified day of the week. The alarm sounds repeatedly at the scheduled time. Two portions of data are selectively utilized, a time portion and a date portion. If the date portion is not utilized, but only the time portion is utilized, then the alarm sounds when the time recurs each twenty-four hour period.

U.S. Pat. No. 4,301,524 comprises a programmable alarm clock which can be set to sound on a seven-day sequence which can be repeated the following week. The alarm is set, or can be set, to sound at a predetermined time on each day of a two-to-six consecutive day cycle. The apparatus is not programmable on a selective day sequence within the seven-day overall cycle. That is, the alarm cannot be set to sound on a Monday and a Tuesday, but not on a Wednesday, Thursday, Friday, and then again on Saturday but not on Sunday. The days that the alarm sounds must be consecutive during the two-to-six day cycle.

SUMMARY OF THE INVENTION

The invention described and claimed herein comprises a programmable alarm clock apparatus which includes switches for selecting any of the seven days of the week in which an alarm may be sounded. The alarm sounds for a predetermined time period, such as ten seconds, and then it automatically shuts off. The apparatus also includes a power failure warning system in which the user is advised by the sounding of an audible alarm that power has failed and that the apparatus needs to be reset.

Among the objects of the present invention are the following:

To provide new and useful alarm clock apparatus;

To provide new and useful electronic alarm clock apparatus;

To provide new and useful programmable alarm clock apparatus;

To provide new and useful electronic time keeping apparatus having a built-in power failure warning system; and To provide new and useful electronic time keeping apparatus programmable to sound an alarm on any day of a seven-day repeating cycle.

DESCRIPTION OF THE PREFERRED EMBODIMENT

Figure 1:
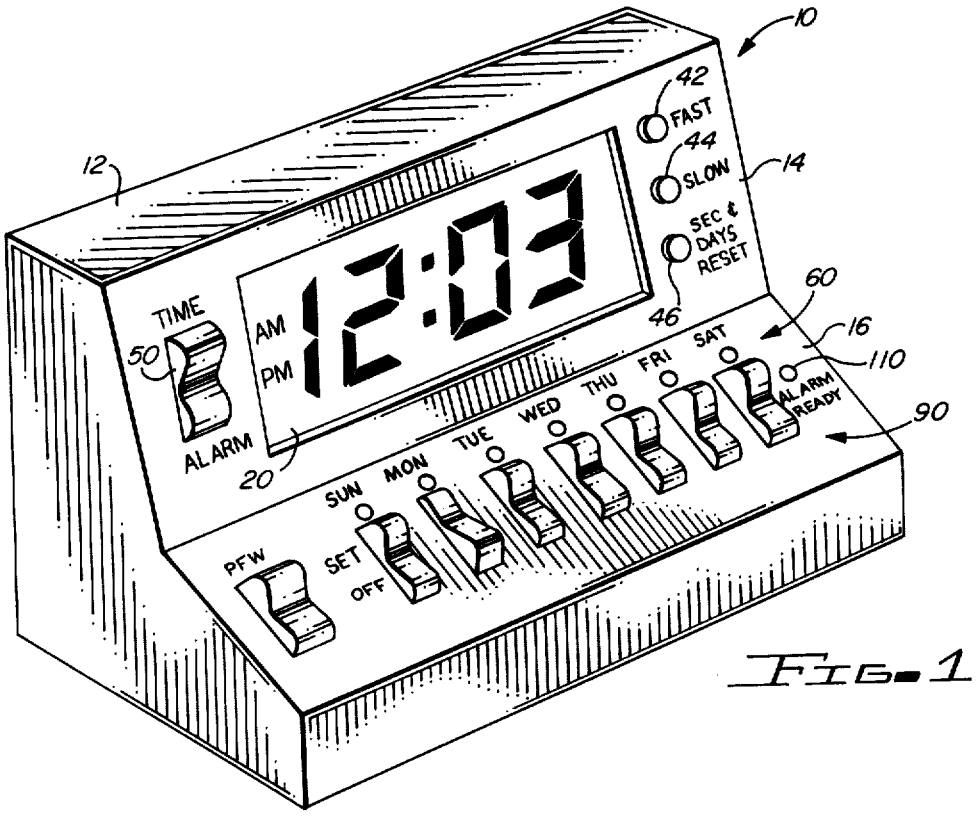
FIG. 1 is a perspective view of the apparatus of the present invention.

FIG. 1 is a perspective view of programmable clock apparatus 10 of the present invention. The apparatus 10 includes a housing 12 in which the various electronic components are located. The exterior of the housing 12 includes two general portions for functional purposes. The two portions may be characterized by a pair of panels, including a time function panel 14 and an alarm function panel 16. The time function panel 14 includes a visual display panel 20 which displays the time in digital elements. The alarm function panel 16 includes a plurality of switches for programming the alarm for the days of the week that the alarm is to sound and the days it is not to sound. A power failure warning switch 120 is also located on the alarm function panel 16.

Figure 2:
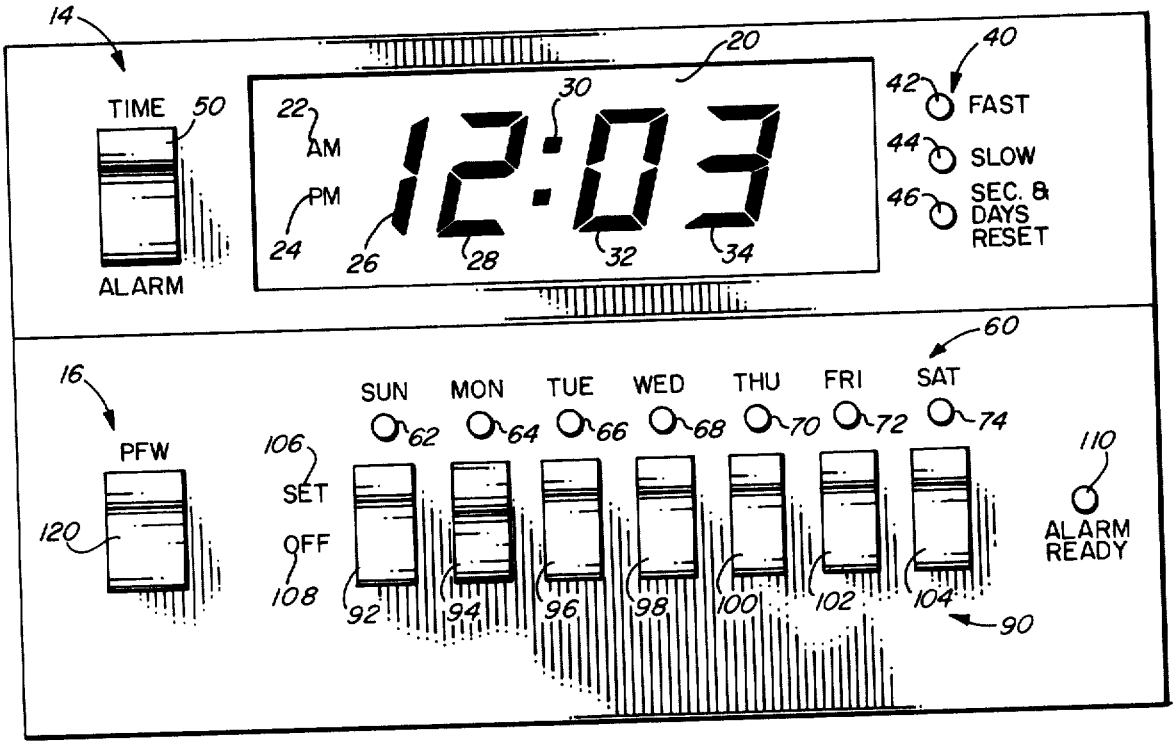
FIG. 2 is a front view of the display and control panel of the apparatus of the present invention.

FIG. 2 is a two-dimensional representation of the time function panel 14 and the alarm function panel 16. The Figure includes the various elements involved in the operation of the apparatus 10. The several elements include a plurality of switches and the time display panel 20 with its various elements. For the following discussion, reference will primarily be made to FIGS. 1 and 2.

For simplicity, the front of the housing 12 is divided into two portions or panels, as indicated above. The upper portion of the housing 12 includes the time function panel 14, and the lower portion includes the alarm function panel 16. Obviously, other configurations could be used for the apparatus of the present invention than that illustrated.

The upper panel, which is the time function panel 14, includes a display panel 20. The display panel 20 is flanked by three set buttons 40 on one side and a time/alarm function switch 50 on the other side. The time function switch 50 is a two-position switch which selects the mode of operation of the display panel 20 and the set buttons 40. When the switch 50 is in the time position, the display panel 20 displays the current time. If it is desired to set in or reset the time to the correct time, then the set buttons 40 may be actuated.

When the time/alarm function switch 50 is set to the alarm position, the set buttons 40 may be used to set in the desired time that the alarm is to sound. This will be discussed in detail below. After the desired alarm time has been set in, the time/alarm function switch should be reset to the time position. The current time will then be displayed on the display panel 20.

The display panel 20 includes an A.M. visual indication 22 and a P.M. visual indication 24. Since the clock apparatus shows time in digital increments, but uses a twelve-hour clock cycle or face instead of a twenty-four hour clock face, the A.M. and P.M. visual indications 22 and 24 are used to determine when the time showing on the clock is morning (A.M.) and when it is afternoon/night (P.M.). An appropriate lamp or LED is used to illuminate the A.M. visual indicator 22 and a similar one is used to illuminate the P.M. visual indicator 24 during the respective appropriate twelve-hour time periods.

The visual indication of the time on the display panel 20 is in a common, seven-segment display having four digits. Each of the four numerical characters or digits has a total of seven segments. Each number is accordingly made of combinations of a maximum of seven segments. This is well known and understood in the art.

The first digit or group of seven segments is for the ten-hour digit, and is identified by reference numeral 26. The second number or digit, for the unit hours, is also a seven segment digital element and is designated by reference numeral 28. A colon (:) 30 is disposed between the unit hours digit 28 and a tens minute digit 32. The colon 30, as is typical in digital clocks and watches, pulses or flashes while the apparatus is functioning. The tens minute digit 32, like the ten hour and the unit hours digits 26 and 28, respectively, is made of seven segments. Finally, the unit minutes digit 34 also includes the standard seven segments.

At twelve noon and twelve midnight, the ten hour digit 26 will be in the configuration of a "1" and the unit hours digit 28 will be in the configuration of a "2". The tens minute digit 32 and the unit minutes digit 34 will both be in the configuration of zeros. The difference between noon and midnight will, of course, be in the A.M. and P.M. visual indicators 22 and 24, respectively. At one minute past the noon and midnight times, the unit minutes digit 34 will become a "1" indicating one minute past twelve o'clock. After noon, or after the meridian, the P.M. visual indicator 24 will be illuminated, while after midnight, the A.M. visual indicator 22 will be illuminated.

At one o'clock, both afternoon and morning, the unit hours digit 28 will display a "1" and the ten hour digit 26 will be blank. The colon 30 will continue to flash all the time that power is applied to the apparatus while it is functioning. All of this is, of course, standard with digital time keeping apparatus which utilize a seven-segment LED or LCD or similar display.

Three set buttons or switches 40 are used to set the time. The set buttons 40 include a fast set button 42, a slow set button 44, and a seconds and days reset button 46. Each of the buttons 42, 44, and 46 is a switch which is spring loaded to the off or open position. Manual pressure is accordingly required to actuate each of the three buttons.

After an initial "power on" situation, as when the apparatus 10 is initially connected to line voltage, or after a power outage has occurred which has disrupted the operation of the apparatus, the A.M./P.M. indicators 22 and 24 will be flashing, the colon 30 will be flashing, and an LED for one of the days, which will be discussed below, will be lit. Any random time may be showing on the digits 26, 28, 32, and 34.

After such power on occurrence, the first procedure to be accomplished is to set the desired alarm time. This is accomplished by moving the time/alarm switch 50 to the alarm position. Then, using the fast button 42 and the slow button 44, the desired alarm time should be set in. While the time/alarm switch 50 is set to the alarm position, the seconds and days reset button 46 is non-functioning.

For fast setting of the clock, using the fast button 42, the time display advances one hour for each second that the button 42 is held in, or is "closed". Thus, the proper or desired hour may be set in utilizing the fast button 42. While setting the hour time, reference should be made to make certain that the correct A.M. or P.M. indicator 22 or 24 is illuminated.

After the appropriate hour has been set in, utilizing the fast button 42, then the minutes are set in using the slow button 44. The slow set button 44 causes the minutes to advance at the rate of two minutes per second. That is, the time will advance at the rate of two minutes for each second that the slow button 44 is held in, which is the closing of the switch 44.

After the appropriate alarm time is displayed on the display panel 20, by the combination, whichever is appropriate, of the ten hour digit 26, the unit hours digit 28, the tens minute digit 32, and the unit minutes digit 34, then the time/alarm switch 50 should be set to the "time" position. The first operation that is accomplished with the switch 50 in the "time" position is to set the apparatus 10 for the correct day. The appropriate day of the week is established by reference to a days display 60. The days display 60 comprises seven LEDs which are illuminated to indicate the various days of the week. Only one of the seven LEDs is "on" or illuminated at any time. The days LED display 60 includes seven LEDs 62, 64, 66, 68, 70, 72, and 74. The LEDs 62 . . . 74 represent, respectively, Sunday, Monday, Tuesday, Wednesday, Thursday, Friday, and Saturday. For conventional households, or for households in which conventional work weeks are used, the Sunday LED 62 and the Saturday LED 74 may be red LEDs, while the Monday . . . Friday LEDs 64 . . . 72 may be green LEDs. Obviously, whether one color or another color is used depends on a particular manufacturer, etc., of the apparatus.

As previously indicated, at such time as the apparatus 10 is initially connected to a power source, one of the day's LEDs 62 . . . 74 will be illuminated. The selection or indication of a particular day at initial power on is random, and in all probability the incorrect day LED will be illuminated and the correct day must accordingly be set in. To set in the proper day, a particular procedure should be followed. The procedure includes, as also indicated previously, the switch 50 being in the "time" position. After the time/alarm switch 50 is in the "time" position, then the three set buttons 42, 44, and 46 must all be actuated and held "in" for a momentary period of time, and then released in a particular sequence. That is, the three set buttons will be sequentially or simultaneously pushed in and held until all three are "in" at the same time. Then the fast button 42 is released, followed by the release of the slow button 44, and finally the release of the seconds and days reset button 46. At such time as the seconds and days reset button 46 is released, the display panel 20 will display 12:00 A.M. and one of the day LEDs of the display 60 will increment one day from what was initially displayed when power was connected. That is, when the seconds and days reset button is released, the digital segments will show 12:00, with the A.M. indicator 22 illuminated, and the days display 60 will have incremented sequentially to the day following the day that was originally indicated at the time the power was connected.

To advance to the correct day, the seconds and days reset button 46 should then be depressed, or held "in" for one second, and then released. Each time the seconds and days reset button 46 is depressed and released, the days display 60 will increment one full day. The time keeping function of the time display 20 will not be affected by the seconds and days reset button 46 during this period of time that the days are incremented to show the correct day. However, the functioning of the clock will continue, in that the clock will keep time, beginning with the twelve A.M. that was "set" by the sequential or simultaneous actuation, holding, and release of the set buttons 40.

After the correct day LED of the days display 60 is illuminated, then the correct current time may be set in the display 20 by operation of the fast and slow buttons 42 and 44, respectively, as discussed above.

It will be noted that the reset of the days may only be accomplished when the time is between twelve A.M. and twelve-fifty-nine A.M. At any other time, the seconds and days reset button is inoperable for resetting of the days. The depressing or pushing of the seconds and days reset button 46 then simply shows the seconds after the current minute that is displayed on the display panel 20.

The resetting of the "days" when the time is between 12:00 A.M. and 12:59 A.M. prevents false days indication and prevents using the seconds and days reset button to reset the days accidentally. Thus, to reset the days once the apparatus is functioning, the time setting procedure for the apparatus must be accomplished by pushing the three set buttons 40, holding them in, and then sequentially releasing them, all as discussed above, and then by following the procedure outlined above.

For showing the seconds after the minute, the visual display 20 changes. The digit 28 becomes the minute digit, and the digits 32 and 34 become seconds digits. On depressing the seconds and days reset button 46, the unit hours digit 28 becomes the unit minutes digit, and the tens minute digit 32 and the unit minutes digit 34 becomes respectively the tens second and the unit seconds digits.

The time may be set to the correct WWV (Universal Coordinated) time by synchronizing the pressing and releasing of the slow and seconds buttons with the appropriate time signal from radio station WWV. When the desired minute and second is set in, the seconds button 46 is depressed before the slow button 44 is depressed to stop the seconds counter in the clock. The slow button is released before the seconds button to start the time keeping function.

With both the desired alarm time set in the apparatus 10, and also the correct current time, including the correct day of the week, set in the apparatus, the next operation is to program the clock to have the alarm sound on any of the desired days of the week. For this function, reference may be made to an alarm selector switch array 90. The alarm selector switches array 90 includes seven two-position switches 92, 94, 96, 98, 100, 102, and 104. The switches 92 . . . 104 represent, respectively, the days of the week Sunday, Monday, Tuesday, Wednesday, Thursday, Friday, and Saturday. It will be noted that the alarm selector switches 90 are parallel to and are aligned with the days display LEDs 60. Thus, the Sunday LED 62 is paralleled with the switch 92 for Sunday, the LED 64 for Monday is paralleled with the Monday selector switch 94, and so on.

Each of the alarm selector switches 90 includes two positions, a "set" position and an "off" position. The positions of the switches are shown by the word "SET" and the word "OFF". The words are respectively designated by reference numerals 106 and 108 in FIG. 2. The words "SET" and "OFF" are preferably printed on the panel 16.

With all of the switches 90 in the "off" position, the alarm time set into the clock apparatus will not cause the alarm to sound. However, when any of the switches 90 is moved to the "set" position, then the alarm will sound at the predetermined alarm time on the days corresponding to the switches that are set. For example, if a user works five days a week, Monday through Friday, and wishes to have the alarm go off at the same time each day, then the switches 94, 96, 98, 100, and 102, representing Monday through Friday, respectively, will be in the "set" position. On the days Monday through Friday, the alarm will sound at the time preset into the clock apparatus. With switches 92 and 104, the Sunday and Saturday switches, respectively, moved to the "off" position, the alarm will not sound on those days.

Adjacent to the switch array 90 is an alarm ready LED 110. The LED 110 is preferably red. When a day of the week LED in the array 60 is coincident with a day of the switch in the array 90 in the "set" position, the alarm ready LED 110 will be illuminated. This indicates that the alarm is set to actuate on or during that particular day. For the alarm ready LED 110 to be illuminated, one of the day switches in the array 90 must be in the "set" position and the corresponding day light or LED in the array 60 must be illuminated. Thus, there must be coincidence between the particular day and the particular alarm selector switch.

During the days that the alarm program switches are in the "off" position, the alarm ready LED 110 will not be illuminated. However, the LED 110 will be illuminated or "on" all during a day that there is the coincidence of a switch and a day LED. The alarm ready LED 110 will remain "on" during the entire twenty-four hour period and will not go "off" after the alarm sounds.

If a person works a Wednesday through Sunday schedule, then the switch 92 and the switches 98,100,102, and 104 would be moved to the "set" position, and the alarm would sound at the predetermined time. However, with the person's days off being Monday and Tuesday, the switches 94 and 96 would be in the "off" position, and the alarm would not actuate or sound on those days. Thus, as will be understood, any one or any more than one of the switches 90 may be in either the "set" or "off" positions. For the switches moved to the "set" position, the alarm will sound at that day. The alarm will not sound on the days indicated or represented by their respective switches in the "off" position.

It will be understood that the clock apparatus 10 may be programmed to have the alarm sound on any of the seven days of the week, as desired. The program for the days of the week that the alarm sounds may also be changed by merely actuating any of the switches 90. When a particular switch is in the "set" position, the alarm will sound on that day. When any of the switches 92 . . . 104 is in the "off" position, the alarm will not sound on that day. Changing of any of the switches 90 from one position to another reprograms the alarm clock apparatus 10.

It will be noted that the switches 90 are aligned in a row, with the switches paired with the days display 60. Also aligned with the switches 90, but separate from the days display 60, is a power failure warning switch 120. The power failure warning switch 120 is spaced slightly apart from the switch 92 of the switches 90, and is on the opposite side of the "SET" 106 and the "OFF" 108 labels. In all other regards, the power failure warning switch 120 is substantially identical to each of the switches 92 . . . 104.

The power failure warning switch 120 is also a two-position switch, just as are the switches 92 . . . 104. It also has a "set" position and an "off" position. In the "set" position, the power failure warning switch is connected to the alarm circuitry. If electrical power fails, with the power failure warning switch in the "set" position, the alarm will sound, notifying the user that power has failed. As is well known and understood, for electronic time keeping apparatus, the failure of the power will interrupt the time keeping processes and, when power is restored, the time keeping information will be erratic or erroneous. When power is restored, random numbers simply appear on the time display, and the random numbers will be used as the basis for the continued time keeping operation after power is restored. Obviously, the random information will not be accurate and accordingly the clock function and the alarm function will be erroneous and will need to be reset or corrected.

If, for example, electrical power were to fail during the night, and then be restored, the correct time would be lost in the clock portion of the apparatus 10, and the alarm would accordingly not sound at the correct time. However, the user of the apparatus 10 would have no way of knowing that until either the alarm went off at the wrong time or the user awoke and discovered, by one means or another, that the time was erroneously displayed on the display panel 20. However, with the power failure warning system built into the apparatus 10, the failure of power would cause the alarm to sound, thus providing an audible indication of power failure. The user, accordingly, would not rely on the information until the clock had been reset to the correct time and the desired alarm time would have also been set into the clock. Or, as indicated above, the desired alarm time would be set into the apparatus first, and then the correct day and time would be set into the apparatus.

With the power failure warning switch 120 in the "off" position, the power failure warning system is disconnected and accordingly would not sound.

As will be discussed below, power for the alarm to sound in conjunction with the power failure warning system is provided by a battery. The warning horn may sound for a predetermined or limited time, if desired, after power failure, in order not to completely drain the battery associated with the power failure warning system. Also, if desired, the power failure warning system may utilize an intermittent or pulsing sound, as opposed to a steady sound, for a limited period of time. Such a system may be advantageous, depending on the circumstances. For example, if power fails during a time when no one is present, the intermittent pulsing or sounding of the alarm may last for a substantial amount of time, several hours if necessary, in order to provide the necessary alert. Obviously, there are several options available to a manufacturer.

At such time as the power failure warning switch 120 is moved to the "off" position, the power failure warning alarm will stop sounding and the entire power failure warning system will be disabled.

It will be noted that if the electrical power is lost only momentarily, the sixty Hertz reference signal from the line voltage will be lost, and accordingly time will drop the two or three seconds in the time keeping mode, but a momentary power loss will not cause the logic to be lost. However, after three or four seconds, the power loss will cause the loss of the logic. When power returns, the electronics will randomly reset both the time and the alarm and accordingly both the time and the alarm will need to be reset. The power failure warning horn alerts the user that power has been lost. When power returns, the entire apparatus will start over with a flashing A.M. indicator 22 or P.M. indicator 24 and the flashing colon 30. Thus, even if a user is not present when the power is lost and the power failure warning horn has ceased sounding before the user returns, the user will be alerted to the fact that power has been lost by the flashing colon 30. The user may also note the incorrect time displayed and the incorrect day of the week visually indicated. The appropriate procedure, all as discussed above, may be effected to set in the apparatus 10 the proper time, day, and alarm time information.

Figure 3:
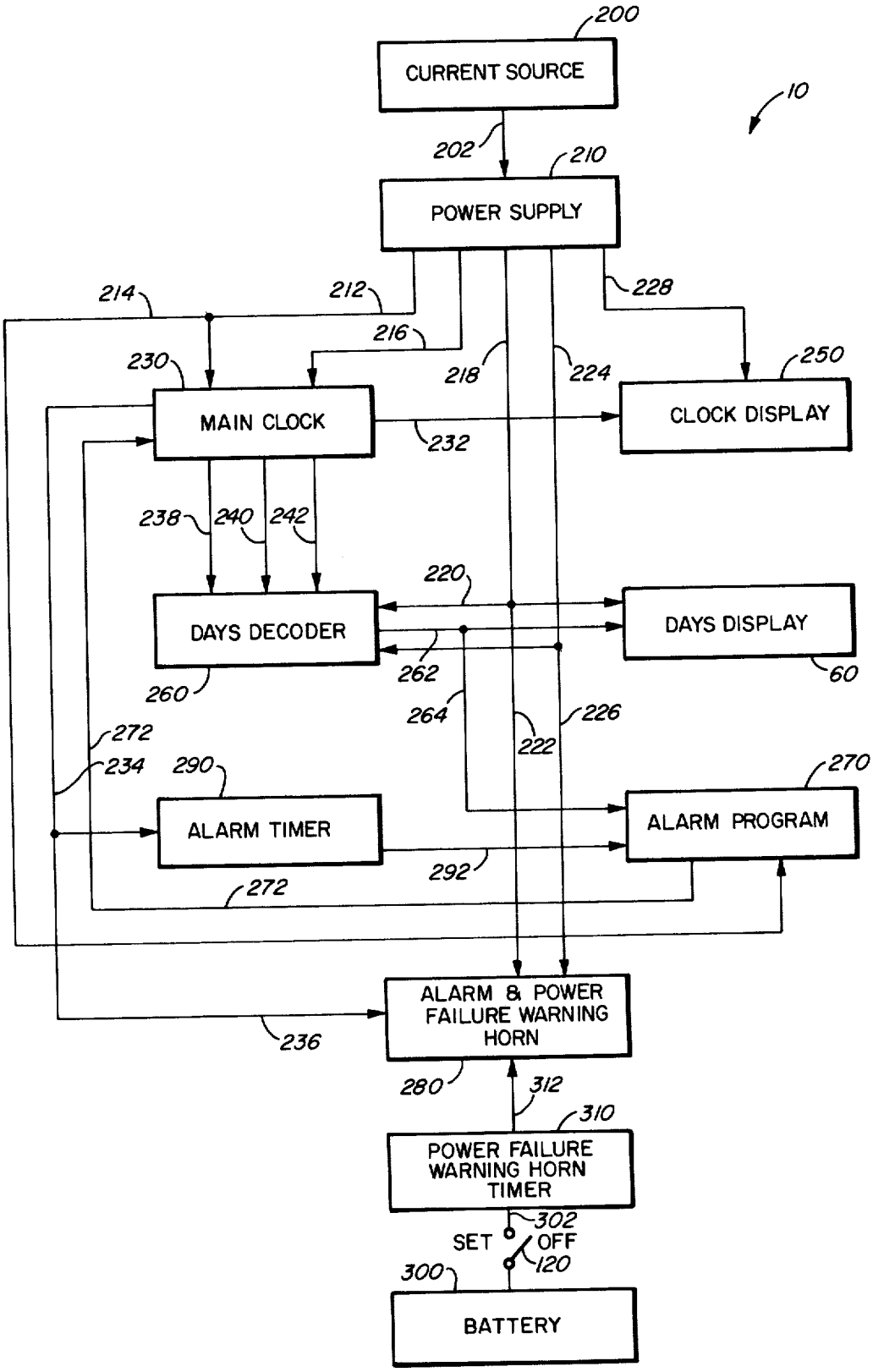
FIG. 3 is a schematic block diagram of the apparatus of the present invention.

FIG. 3 is a schematic block diagram of the circuitry involved in the apparatus of the present invention. The apparatus 10 is appropriately connected to a one-hundred-twenty volt, sixty Hertz, alternating current source 200. The current source 200 is in turn connected to a power supply 210 by an appropriate conductor(s) 202. The power supply 210 provides several different voltages which are required for the various electronic elements involved in the apparatus 10. Five different lines, representing conductors, extend from the power supply 210 to the different elements which are included in the apparatus 10. Each line or conductor represents a different voltage required by the various elements to which the conductors extend.

A conductor 212 extends from the power supply 210 to a main clock 230. From the conductor 212, a conductor 214 extends to an alarm program 270. The alarm program 270 includes the alarm selector switches 90 and the alarm ready visual indicator or LED 110, shown in FIGS. 1 and 2. For one embodiment of the apparatus 10, the conductors 212 and 214 provide plus 22 volts DC from the power supply 210 to the main clock 230 and the alarm program 270.

A second conductor 216 extends from the power supply 210 to the main clock 230. The conductor 216 provides plus seventeen volts AC to the main clock 230.

A conductor 218 extends from the power supply 210 to a days decoder block 260. From the conductor 218, a conductor 220 extends to the days display 60. A conductor 222 extends from the conductor 220 to an alarm and power failure warning horn block 280. The conductors 218, 220, and 222 provide plus twelve volts DC to the three elements from the power supply 210.

A conductor 224 extends from the power supply 210 to the days decoder 260, to provide minus eight volts DC for the days decoder 260. The conductor 226 extends from the conductor 224 to the alarm and power failure warning horn 280.

A conductor 228 extends from the power supply 210 to a clock display 250. The conductor 228 provides plus two volts AC from the power supply for the clock display 250. The clock display 250 includes the elements discussed in conjunction with the display panel 20, as shown in FIGS. 1 and 2. They include the A.M. and P.M. visual indicators 22 and 24, respectively, and the seven segments for each of the digits 26, 28, 32, and 34, and also the colon 30.

It will be noted that some of the elements in the apparatus of the present invention require more than one voltage. Appropriate conductors accordingly extend to the elements to provide the necessary voltages.

The functioning of the main clock 230 is well known and understood in the art. It uses the sixty Hertz from the line voltage of the current source 200 as a reference for the timekeeping functions. Appropriate integrated circuitry is used to provide the clock functions of the main clock 230. The set buttons 40 are part of the main clock 230.

From the main clock 230, a conductor 232 extends to the clock display 250. The clock display 250 receives the appropriate signals from the main clock 230 for incrementing the digits on the display panel 20 to indicate the appropriate time. The A.M. visual indicator 22 and the P.M. visual indicator 24 are also incremented or activated in response to the appropriate signals from the main clock 230.

The days decoder 260 is appropriately connected to the A.M. indicator 22 and to the ten hour digit 26 and to the unit hours digit 28 so that the days reset button 46 may only function between 12:00 A.M. and 12:59 A.M. This has been discussed above in detail.

The main clock 230 is connected to the days decoder 260 by three conductors 238, 240, and 242. The days decoder 260 increments one day each twenty-four hour period. The days consecutively advance from Sunday through Saturday and then back to Sunday, in sequence.

The main clock 230 is connected to an alarm timer 290 by a conductor 234. A conductor 236 extends from the conductor 234 to an alarm and power failure warning alarm 280 to connect the main clock to the alarm and power failure warning horn.

The time keeping function, including the storing of the set in alarm time, is accomplished by the main clock 230. A signal from the main clock 230 to the alarm timer 290 and the alarm horn 280 on the conductors 234 and 236 occurs at the time set for the alarm to sound.

The days decoder 260 is connected to the days display 60 by a conductor 262. A conductor 264 extends from the conductor 262 to the alarm program 270 to connect the days decoder to the alarm program. Information as to the particular day of the week thus is transmitted to the days display 60 and to the alarm program 270.

One of the LEDs 62 . . . 74 is illuminated to visually indicate the day of the week. Each day, of course, at midnight, the appropriate LED corresponding to the actual day of the week is illuminated.

The conductors 262 and 264, which extend from the days decoder 260 to the days display 60 and the alarm program 270, actually include two outputs from each of several output terminals. The days decoder 260 includes seven output terminals, each representing a day of the week. Two conductors extend from each terminal, one conductor extends to the appropriate or corresponding days display LED and one conductor extends to the alarm program 270. Each conductor of the conductors 264, which extends to the alarm program 270, extends to one of the switches 90 which corresponds to the respective days of the week. The conductor 264 accordingly includes seven conductors which extend to a corresponding one of the seven switches 92 . . . 104 of the program selector switches 90.

Since the switches 90 are each two position switches, having a "set" position, which is a connected or closed position, and an "off" or "open" position, the alarm 280 will sound only when an appropriate switch is in its closed or set position, and the particular day signal is coincident with the selected and set switch. In addition to the coincidence of the day information, there must also be an appropriate coincident signal from the main clock that coincides with the time selected as the alarm time.

When there is a coincidence between one of the alarm selector switches 90 and one of the days display 60, there will be an alarm ready signal transmitted from the alarm program 270 to the main clock 230 on a conductor 272. The alarm ready signal on the conductor 272 allows the main clock 230 to transmit an appropriate signal to an alarm timer 290 and the alarm and power failure warning horn 280 on conductor 234 and 236 when the preselected alarm time occurs. The signal thus transmitted on conductors 234 and 236 results, at the appropriate time, in the horn 280 sounding.

The signal that causes the horn to sound is also transmitted to the alarm timer 290 by the conductor 234. The conductor 236 extends to the horn block 280 from the conductor 234. When the signal from the clock 230 or conductor 234 is received by the alarm timer 290, a timing circuit, not shown but well known and understood in the art, is activated. At the end of the desired time period for the timing circuit, such as ten seconds, an appropriate signal is transmitted on conductor 292 from the alarm timer 290 to the alarm program 270.

The signal transmitted on conductor 292 from the alarm timer 290 to the alarm program 270 causes the alarm program to be deactivated, thus terminating the alarm ready signal to the clock 230 on conductor 272. When the alarm ready signal on conductor 272 is terminated to the main clock 230, the main clock terminates its signal on conductors 234 and 236, and the horn 280 stops. The alarm horn 280 thus sounds for only a limited, relatively short period of time, such as ten seconds.

The length of time which the horn sounds is determined by the alarm timer 290. If desired, of course, the alarm time, or the length of time the alarm sounds, can be lengthened or shortened.

As indicated above, the alarm and power failure warning horn 280 is directly connected to the power supply 210 by two conductors which furnish appropriate voltages for the horn. The signal from the main clock 230 on conductors 234 and 236 to the horn 280 allows the horn to sound, but does not provide the power for the horn. The electrical power for the horn is derived from the power supply 210.

It will be understood that the alarm and power failure warning horn block 280 includes an oscillator connected to a speaker. The oscillator circuitry provides the output signal for the speaker. The oscillation frequency of the oscillator circuitry determines the actual sound or audible output of the speaker. The oscillator circuit is powered in the alarm mode by twelve volts d.c. on conductor 222 from the power supply 210. In the power failure warning horn mode, the oscillator is powered by nine volts from the battery 300. Minus eight volts d.c. on conductor 226 to the alarm and power failure warning horn block 280 is utilized in the control circuitry for the oscillator. Broadly speaking, the "horn" portion of the block 280 includes the oscillator and the speaker for providing an audible output.

Since the same oscillator and speaker is used to sound both the alarm at the predetermined alarm times and the alarm upon the failure of electrical power, the block 280 is identified as the "alarm and power failure warning horn" block. A single "horn" is used, but two functions are accomplished by the "horn" in the block, an audible time alarm and an audible power failure warning alarm.

The failure of electrical power of more than a few seconds will cause the time keeping function of the main clock 230 to be lost. This has been stated in detail above. When power is restored, such as after a power outage, the time keeping function is started over, but until the correct time is set into the main clock 230, the time keeping function will simply begin using a random time as the beginning basis. Accordingly, the time keeping alarm functions will generally be completely erroneous when power is reconnected. To alert the user of the apparatus that power has failed, a power failure warning system is incorporated into the apparatus 10.

The power failure warning system includes a battery 300, which comprises a source of direct current power. The battery 300 is preferably a common nine-volt battery. The battery 300 is connected to a power failure warning timer 310 by a conductor 302. The power failure warning horn timer 310 is in turn connected to the power failure warning portion of the horn block 280 by a conductor 312.

Within the alarm and power failure warning horn block 280 are two circuits, the horn circuit which sounds in response to the signal received from the main clock 230 on the conductors 234 and 236, and the power failure warning circuit that causes the horn to sound when electrical power from the power supply 210 on conductors 222 and 226 ceases.

The alarm and power failure warning horn 280 includes the oscillator circuit, which is well known and understood in the art. The same oscillator circuit is also used for the power failure warning horn. As long as electrical power from the power supply 210 is connected to the alarm and power failure warning horn circuitry 280, the alarm horn will sound only when the signal is received from the main clock 230 on the conductors 234 and 236. However, when electrical power from the power supply 210 is lost, the oscillator circuit begins to oscillate utilizing electrical current from the battery 300.

The power failure warning switch 120, as discussed above, is a two-position switch, substantially identical to the alarm selector switches 92 . . . 104. As illustrated in FIGS. 1 and 2, the switch 120 is aligned with the alarm selector switches 92 . . . 104, in the array 90. When the power failure warning switch 120 is in its set position, the battery 300 is connected through the switch 120 to a power failure warning horn timer 310. The power failure warning horn portion of the block 280 is connected to the battery 300 through the power failure warning horn timer 310. When the switch 120 is in the "off" position, the battery 300 is disconnected from the power failure warning horn timer 310 and the power failure warning portion of the block 280. With the switch 120 in the "off" or "open" position, a loss of electrical power will not result in the horn portion of the block 280 sounding. However, with the switch 120 in the "set" or "on" (connected) position, the battery 300 is connected to the power failure warning portion of the block 280, and a loss of electrical power results in the sounding of the alarm horn in the block 280.

The power failure warning horn timer 310 may include appropriate circuitry, such as a capacitor, which charges slowly over a desired and predetermined time period while the horn is sounding after a loss of electrical power. When the desired time during which the horn sounds has elapsed, electrical power from the battery 300 to the horn ceases and the horn turns off. For example, if the "on" time of the horn in the power failure mode is dependent on the time constant of a capacitor, after the capacitor has charged, the current to the oscillator stops flowing and the horn turns off. This is well known and understood in the art.

The time constant of the charging capacitor determines the length of time that the oscillating circuit is operable to cause the warning horn to sound. By selecting a capacitor with the appropriate time constant, the length of time that the power failure warning horn sounds after power has failed is determined. If desired, appropriate circuitry could be utilized in the timer block 310 to cause the horn to sound in a pulsing or pulsating manner. The intermittent sounding of the horn would thus differentiate the horn from, say, the normal alarm mode of the apparatus 10.

In summary, it will be understood that the apparatus 10 visually indicates the time on the display panel 20 of the clock display 250, and the day of the week by the days display 60. Through the alarm program 270, the apparatus 10 may be programmed to sound only on specified days. The programming is accomplished by merely actuating any of the seven switches, and the changing of the switches results in reprogramming the alarm function.

By utilizing an alarm timer, such as the timer 290, the alarm horn sounds for only a predetermined length of time and then shuts down automatically. When the alarm horn turns off or shuts down, it is then ready for actuation on the day next selected by the alarm program 270, and the appropriate switches in the array 90. The alarm function thus operates automatically to sound on the preselected days at the predetermined time. Obviously, the time that the alarm sounds may be changed to suit the user. Similarly, the days on which the alarm is to sound may be changed by simply moving any of the switches 92 . . . 104 is the switch array 90 between their two positions, set and off.

The programmable alarm apparatus 10 also provides a warning sound to indicate to a user that electrical power to the apparatus has failed.

While the principles of the invention have been made clear in illustrative embodiments, there will be immediately obvious to those skilled in the art many modifications of structure, arrangement, proportions, the elements, materials, and components which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Programmable alarm clock apparatus, comprising, in combination:

clock means, including a clock for determining time on daily, hourly, and minute basis, display means for displaying time on an hourly and minute basis, and display means for indicating the day of the week;

alarm means, including means for selecting an alarm time on an hour and minute basis, means for selectively programming the alarm time on a day of the week basis, means for providing a first audible alarm at the selected alarm time and on the selected days of the week, and first timer means for turning off the audible alarm after a first predetermined time period;

first electrical power means for providing electrical power to the clock means and the alarm means;

power failure warning means for providing a second audible alarm upon the failure of electrical power from the first electrical power means;

second timer means for turning off the second audible alarm after a second predetermined time period; and second electrical power means for providing electrical power to the power failure warning means and to the second timer means and to the alarm means upon failure of the first electrical power means for the second audible alarm.

2. The apparatus of claim 1 in which the means for programming the alarm time on a day of the week includes switch means, including a plurality of switches, each of which represents a different day of the week, for selecting any or all or none of the days of the week for the alarm to sound.

3. The apparatus of claim 2 in which the clock means further includes means for displaying time on a minute and second basis.

* * * * *